US006515242B2

(12) United States Patent
Takatsuki

(10) Patent No.: US 6,515,242 B2
(45) Date of Patent: Feb. 4, 2003

(54) SWITCH DEVICE

(75) Inventor: Hiroki Takatsuki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 6 days.

(21) Appl. No.: 09/784,600

(22) Filed: Feb. 15, 2001

(65) Prior Publication Data

US 2001/0013464 A1 Aug. 16, 2001

(30) Foreign Application Priority Data

Feb. 16, 2000 (JP) ..... 2000-043611

(51) Int. Cl.[7] ..... H01H 19/00
(52) U.S. Cl. ..... 200/6 A; 200/5 R
(58) Field of Search ..... 200/6 A, 5 R, 200/315, 16 C, 517, 1 R, 4 A, 5 A, 5 E, 6 R, 17 R, 18, 313, 314

(56) References Cited

U.S. PATENT DOCUMENTS 4,687,200 A 8/1987 Shirai
4,975,547 A 12/1990 Nakayama et al.
5,689,095 A * 11/1997 Kawase ..... 200/5 R
5,731,558 A * 3/1998 Kyoden ..... 200/5 R
5,901,834 A * 5/1999 Inubushi et al. ..... 200/314
6,069,327 A * 5/2000 Ushimaru ..... 200/5 R
6,153,844 A * 11/2000 Hyono et al. ..... 200/343
6,303,887 B1 * 10/2001 Ando ..... 200/512

FOREIGN PATENT DOCUMENTS

JP 7-57586 * 3/1995
JP 7-201249 * 8/1995
JP 8-112822 * 5/1996
JP 10-334770 * 12/1998

* cited by examiner

*Primary Examiner*—Michael Friedhofer
*Assistant Examiner*—Lisa N Klaus
(74) *Attorney, Agent, or Firm*—Brinks Hofer Gilson & Lione

(57) ABSTRACT

A switch device having uniform operability includes an operating member which is rockably stopped by a case, a rubber spring including four spring sections which are disposed at peripheral edges of the operating member inside the case, respectively, and three switches which are disposed in correspondence with three of the four spring sections. The spring sections are selectively actuated two at a time as a result of rocking the operating member in one direction. In the switch device, the spring sections are actuated and buckled by operating the operating member in order to switch the switches. In addition, the click ratio of the spring section which is not provided with a switch is greater than the click ratios of the spring sections which are provided with the switches.

8 Claims, 10 Drawing Sheets

SWITCH DEVICE

BACKGROUND OF THE INVENTION

1. Field of the Invention

The present invention relates to a switch device, and, more particularly, to a switch device which is suitable for use in driving a mirror of an automobile.

2. Description of the Related Art

The switch device is used for remotely controlling a mirror which is mounted to, for example, the body of an automobile from the driver's seat by the driving power of a motor. In addition, the switch device is used to selectively operate a plurality of switches which are disposed inside a case by pressing an operating section which is rockably stopped at the top portion of the case.

A description of a conventional switch device is given with reference to the relevant drawings.

FIG. 14 is an exploded perspective view of a conventional switch drive. FIG. 15 is a sectional view of the conventional switch device.

As shown in FIG. 14, the conventional switch device comprises a case 21 having an open bottom end and a cover 29 for covering the open end of the case 21. The case 21 and the cover 29 are snappingly coupled together, whereby the external shell of the switch device is formed.

A printed wiring board 28 having three stationary contacts 28*a* formed thereon is placed on the cover 29. Three sliding members 25 having corresponding movable contacts 27 affixed thereon are placed above the corresponding stationary contacts 28*a* which are formed on the printed wiring board 28, with each of the movable contacts 27 being disposed so that it can come into contact with and separate from its corresponding stationary contact 28*a* by sliding.

The three stationary contacts 28*a* which are formed on the printed wiring board 28 and the three sliding members 25 which have the corresponding movable contacts 27 affixed thereto form three switches.

A substantially square recess 21*a* is formed in the top surface of the case 21. Clearance holes 21*b* are formed in three of the four corners of the recess 21*a*.

A protruding wall 21*d* having a through hole 21*c* is formed in the center of the recess 21*a*.

Three actuating members 22 are provided, each of which comprises a circular cylindrical base 22*a* and substantially semicircular ends 22*b* which are provided on both ends of its corresponding base 22*a*.

A rubber spring 23 comprises a flat, substantially rectangular base 23*a,* substantially dome-shaped spring sections 23*b*-1, 23*b*-2, 23*b*-3, and 23*b*-4, and planar presser sections 23*c*-1, 23*c*-2, 23*c*-3, and 23*c*-4. The spring sections 23*b*-1, 23*b*-2, 23*b*-3, and 23*b*-4 are formed on the four corners of the base 23*a,* respectively. The presser sections 23*c*-1, 23*c*-2, 23*c*-3, and 23*c*-4 have circular cylindrical shapes, are formed on ends of the corresponding spring sections 23*b*-1, 23*b*-2, 23*b*-3, and 23*b*-4, and have their ends formed parallel to the base 23*a,* that is, in a horizontal direction.

The spring sections 23*b*-1, 23*b*-2, 23*b*-3, and 23*b*-4 function as what are called buckling sections.

A rectangular through hole 23*d* is formed in the center of the base 23*a*. An inside wall 23*e* is formed on the base 23*a* in a standing manner so as to surround the peripheral portion of the through hole 23*d*.

All of the four spring sections 23*b*-1, 23*b*-2, 23*b*-3, and 23*b*-4 which function as buckling sections have the same wall thicknesses L3 (such as approximately 0.6 mm). Therefore, the click ratios of the four spring sections 23*b*-1, 23*b*-2, 23*b*-3, and 23*b*-4 are individually the same.

The rubber spring 23 is accommodated inside the recess 21*a* of the case 21. At this time, the actuating members 22 are in contact with the inside walls of the three corresponding presser sections 23*c*-1, 23*c*-2, and 23*c*-3, and are disposed so as to be slidable inside their corresponding clearance holes 21*b* in the case 21. The presser section 23*c*-4 is not provided with an actuating member. The through hole 23*d* in the rubber spring 23 is disposed so as to oppose the through hole 21*c* in the case 21.

As shown in FIG. 15, an operating member 24 is formed of, for example, a synthetic resin material by molding. The operating member 24 comprises a substantially rectangular top wall 24*a,* side walls 24*b* which extend in a substantially vertical direction from the peripheral ends of the top wall 24*a* so as to surround the peripheral end portions of the top wall 24*a,* and four cylindrical actuating sections 24*c* which are cross-shaped in cross section and which protrude inwardly from the vicinity of the four corresponding corners of the top wall 24*a*.

An end surface of each actuating section 24*c* of the operating member 24 is formed with the same predetermined tilt angle al (such as approximately three degrees) with respect to the top wall 24*a* (that is, the horizontal plane). Each end surface extends radially outward from substantially the center of the operating member 24.

A description of the operation of the switch device will now be given.

As shown in FIG. 14, when, for example, the operator presses substantially the center portion of the lower left end side of the operating member 24 shown in FIG. 14 with, for example, his/her finger (not shown), the operating member 24 tilts to the lower left side. When the operating member 24 tilts to the lower left side, the two left actuating sections 24*c* and 24*c* of the operating member 24 are pushed downward. When these two left actuating sections 24*c* and 24*c* are pushed, the corresponding presser sections 23*c*-1 and 23*c*-2 of the rubber spring 23 which have been brought into contact with the two left actuating sections 24*c* and 24*c* are pushed downward.

When each of the presser sections 23*c*-1 and 23*c*-2 of the rubber spring 23 is pushed, each of the spring sections 23*b*-1 and 23*b*-2 buckles as the operator is provided with a tactile feel, so that the operator is provided with a proper tactile feel. At this time, the presser sections 23*c*-1 and 23*c*-2 cause the two actuating members 22 which are in contact with the inside walls of their corresponding presser sections 23*c*-1 and 23*c*-2 to be pushed and to slide downward.

When these two actuating members 22 slide downward, the ends 22*b* of each of these actuating members 22 move downward on inclined portions 25*c* of the two corresponding sliding members 25. Here, these two sliding members 25 slide, along with their corresponding movable contacts 27, above the corresponding stationary contacts 28*a* which are formed on the printed wiring board 28 so as to go against the resilient forces of corresponding coil springs 26.

When these two sliding members 25 slide, each of the corresponding movable contacts 27 comes into contact with its corresponding stationary contact 28*a,* so that two switches are brought into an on state.

Next, when the operator moves his/her finger off the operating member 24, the resilient forces of the two corresponding coil springs 26 cause the two corresponding sliding members 25 to slide back to their original positions.

Here, each of the corresponding movable contacts 27 separates from its corresponding stationary contact 28*a,* so that the two switches are brought into an off state.

By the sliding of the two sliding members 25, the corresponding actuating members 22 are pushed upward, and the operating member 24 is pushed upward to its original position by the self-restoring force of the rubber spring 23.

As shown in FIG. 14, when the operator presses, for example, substantially the center portion of the upper left end side of the operating member 24 shown in FIG. 14 with, for example, his/her finger (not shown), the operating member 24 tilts to the upper side. When the operating member 24 tilts to the upper side, the corresponding actuating sections 24*c* of the operating member 24 are pushed downward. When these actuating sections 24*c* are pushed downward, the corresponding presser sections 23*c*-1 and 23*c*-4 of the rubber spring 23 which have come into contact with these actuating sections 24*c* are pushed downward.

The operations which follow the pushing down of the presser sections 23*c*-1 and 23*c*-4 are substantially the same as those when substantially the center portion of the lower left end side of the operating member 24 is pressed, so that the details thereof will be omitted. However, since an actuating member 22 and a switch are not provided below the presser section 23*c*-4, the one switch which is disposed below the presser section 23*c*-1 is brought into an on state. Thereafter, the operating member 24 is restored to its original position by the self-restoring force of the rubber spring 23, so that the one switch is brought into an off state.

A description of the clicking characteristics which are provided during the operation of the switch device will be given.

FIG. 16 is a graph illustrating the clicking characteristic which is provided when two switches of the conventional switch device are actuated. FIG. 17 is a graph illustrating the clicking characteristic which is provided when one switch of the conventional switch device is actuated.

As shown in FIG. 16, when two switches are actuated by pushing, for example, the spring sections 23*b*-1 and 23*b*-2 at the same time as a result of pushing a predetermined location of the operating member 24 (see FIG. 15) of the conventional switch device, the clicking characteristic represented by Graph C is obtained. Graph C represents the clicking characteristic in which the change in load which occurs when the corresponding spring sections buckle becomes small due to the actuating forces required to actuate two switches.

As shown in FIG. 17, when only one switch is actuated by-pushing, for example, the spring section 23*b*-1 and the spring section 23*b*-4 at the same time as a result of pushing a predetermined location of the operating member 24 of the conventional switch device, the clicking characteristic represented by Graph D is obtained. Graph D represents the clicking characteristic in which the change in load is greater than that in Graph C because an actuating force for actuating only one switch is required.

As can be understood from the foregoing description, the conventional switch device exhibits the clicking characteristic shown in either Graph C or Graph D depending on the pressing location (that is, the pressing direction) of the operating member 24, so that a difference in the clicking characteristics occurs depending on the pressing location.

In the conventional switch device, either one or two switches are actuated depending on the pressing location of the operating member. Therefore, the clicking characteristic which is provided when one switch is actuated and that which is provided when two switches are actuated are different, giving rise to the problem that the operator experiences a different tactile feel when operating the operating member.

SUMMARY OF THE INVENTION

Accordingly, in order to overcome the above-described problem, it is an object of the present invention to provide a switch device which is uniformly operable as a result of providing a uniform tactile feel regardless of the directions of pressing locations of an operating member which is operated by an operator with, for example, his/her finger.

To this end, according the present invention, there is provided a switch device comprising an operating member which is stopped by a case so as to be rockable in four directions, a rubber spring including four spring sections, one first spring section and three spring sections, and three switches which are disposed in correspondence with the three second spring sections, with the remaining one first spring section not being provided with a switch. The spring sections are disposed at peripheral edges of the operating member inside the case, respectively, with the spring sections being selectively actuated two at a time as a result of rocking the operating member in one direction. In the switch device, the spring sections are actuated and buckled by operating the operating member in order to switch the switches. In addition, a click ratio of the first spring section is greater than click ratios of the second spring sections.

The four spring sections may be disposed at locations which oppose four corners of the operating member, respectively.

When the four spring sections are disposed at locations which oppose four corners of the operating member, respectively, each spring section may comprise a buckling section, and a wall thickness of the buckling section of the first spring section may be greater than wall thicknesses of the buckling sections of the second spring sections.

When the four spring sections are disposed at locations which oppose four corners of the operating member, respectively, each spring section may comprise a buckling section, and a tilt angle of the buckling section of the first spring section with respect to the case may be greater than tilt angles of the buckling sections of the second spring sections with respect to the case.

When the four spring sections are disposed at locations which oppose four corners of the operating member, respectively, the click ratio of the spring section which is greater than the click ratios of the three other spring sections may be approximately 50%, and the click ratios of the three other spring sections may be approximately 33%.

When the four spring sections are disposed at locations which oppose four corners of the operating member, respectively, the operating member may be resiliently biased by the spring sections, the operating member being stopped at the case by a resilient force thereof.

When the four spring sections are disposed at locations which oppose four corners of the operating member, respectively, each switch may comprise a printed wiring board which is, disposed inside the case, a stationary contact which is formed on its corresponding printed wiring board, a slider which slides above its corresponding printed wiring board, and a movable contact which is disposed at its corresponding slider. In each switch, each slider slides by its corresponding spring section in order to switch its corresponding switch.

DESCRIPTION OF THE PREFERRED EMBODIMENT

A description of a switch device of the present invention will be given with reference to the relevant drawings.

Figure 1:
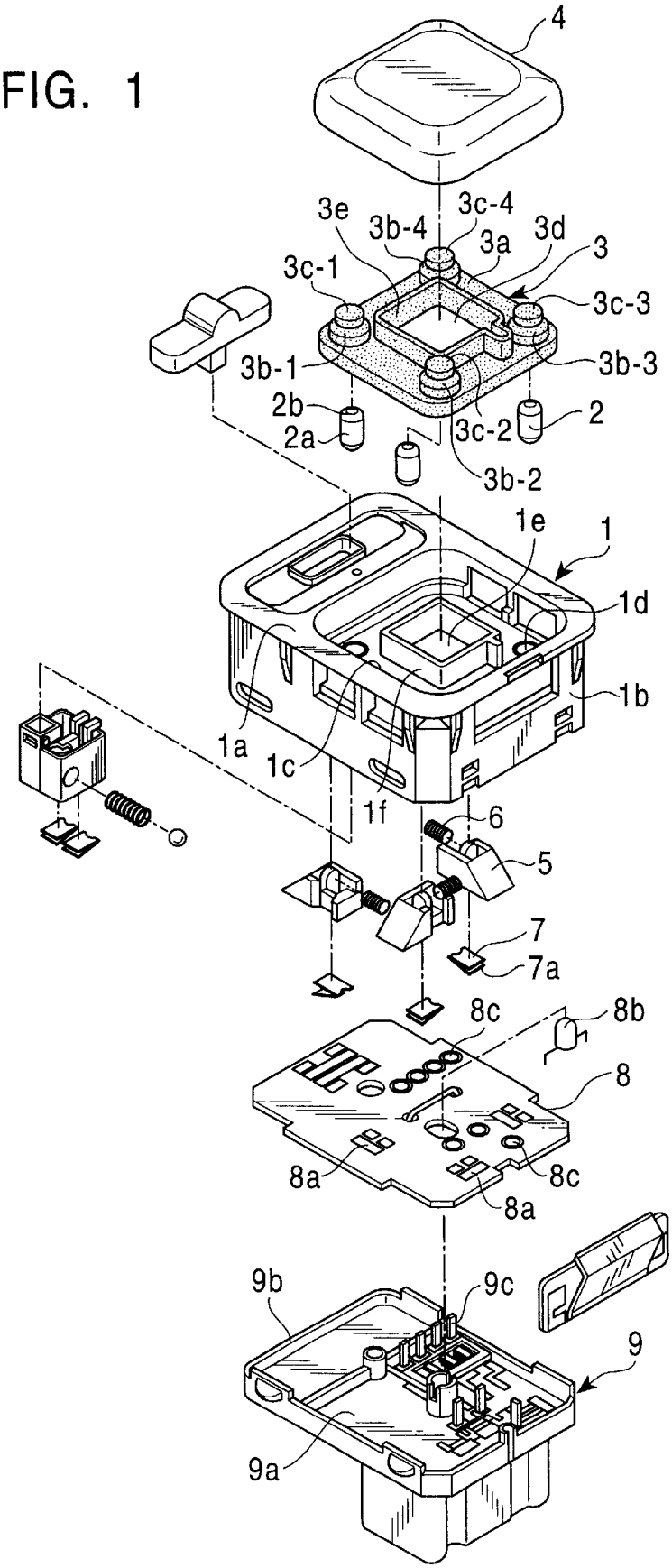
FIG. 1 is an exploded perspective view of an embodiment of a switch device in accordance with the present invention.
Figure 2:
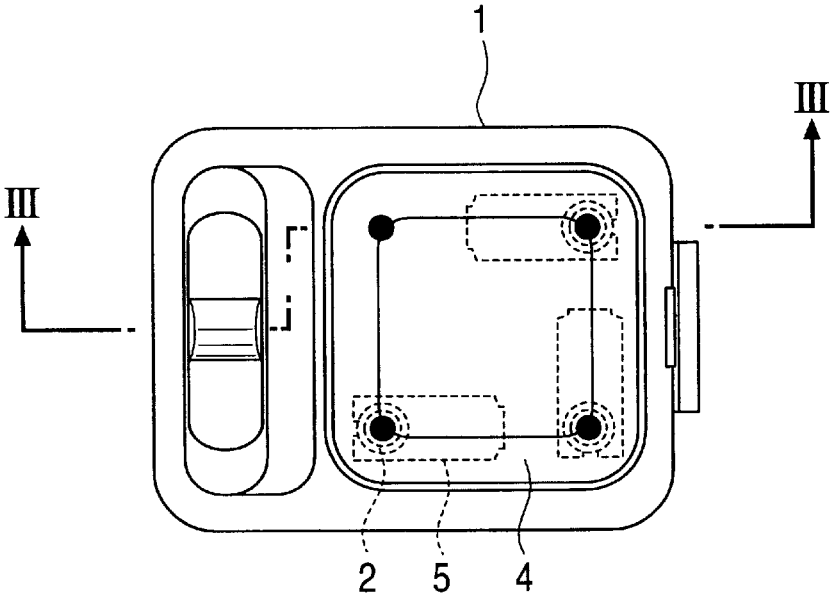
FIG. 2 is a plan view of the embodiment of the switch device in accordance with the present invention.
Figure 3:
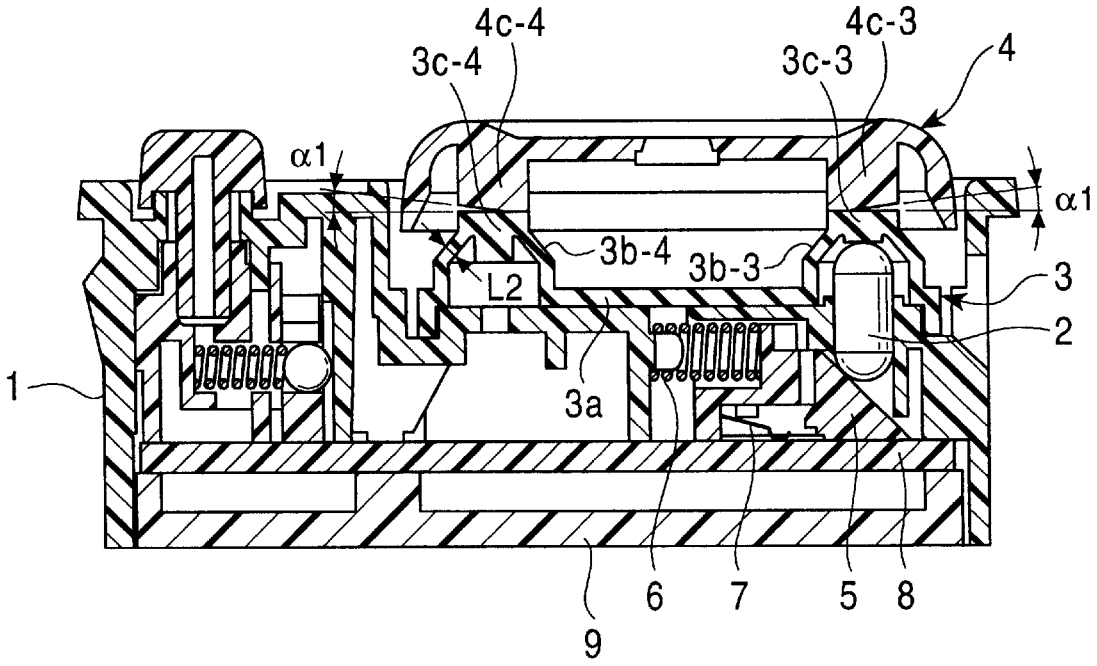
FIG. 3 is an enlarged sectional view taken along line III—III of FIG. 2.

FIG. 1 is an exploded perspective view of an embodiment of a switch device in accordance with the present invention. FIG. 2 is a plan view of the embodiment of the switch device in accordance with the present invention. FIG. 3 is an enlarged sectional view taken along line III—III of FIG. 2.

As shown in FIG. 1, a case 1 is formed of, for example, a synthetic resin material by molding, and is substantially box-shaped. The case 1 comprises a substantially rectangular top wall 1*a,* side walls 1*b* which extend vertically from near the outer peripheral end of the top wall 1*a* so as to surround all sides of the case 1, and a substantially rectangular recess 1*c* which is formed in the top wall 1*a*.

Circular clearance holes 1*d,* a rectangular through hole 1*e,* and a protruding wall 1*f* are formed at the recess 1*c*. The clearance holes 1*d* are formed near three of the four corners of the recess 1*c*. The through hole 1*e* is formed in the center of the recess 1*c*. The protruding wall 1*f* extends vertically into the recess 1*c* from the periphery of the through hole 1*e*.

Although not shown, the side of the case 1 opposing the top wall 1*a* is open.

Three actuating members 2 are formed of, for example, a synthetic resin material by molding. Each actuating member 2 comprises a circular cylindrical base 2*a* and semicircular ends 2*b* which are provided on both ends of its corresponding base 2*a*.

Each actuating member 2 is slidably disposed in its corresponding clearance hole 1*d* in the case 1. Here, the ends 2*b* of each actuating member 2 are disposed so as to protrude outwardly from their corresponding clearance holes 1*d*.

A rubber spring 3 is formed of, for example, a resilient rubber material by molding. The rubber spring 3 comprises a flat, substantially rectangular base 3*a,* substantially dome-shaped first, second, third, and fourth spring sections 3*b*-1, 3*b*-2, 3*b*-3, and 3*b*-4, and planar first, second, third, and fourth presser sections 3*c*-1, 3*c*-2, 3*c*-3, and 3*c*-4. The first, second, third, and fourth spring sections 3*b*-1, 3*b*-2, 3*b*-3, and 3*b*-4 are provided at the four corners at the peripheral edges of the base 3*a,* respectively. The first, second, third, and fourth presser sections 3*c*-1, 3*c*-2, 3*c*-3, and 3*c*-4 have circular cylindrical shapes, are formed on ends of the corresponding first, second, third, and fourth spring sections 3*b*-1, 3*b*-2, 3*b*-3, and 3*b*-4, and have their ends formed parallel to the base 3*a,* that is, in a horizontal direction. A rectangular hole 3*d* is formed in the center of the base 3*a*. An inside wall 3*e* is formed on the base 3*a* in a standing manner so as to surround the hole 3*d*. The first, second, third, and fourth spring sections 3*b*-1, 3*b*-2, 3*b*-3, and 3*b*-4 function as what are called buckling sections.

Figure 8:
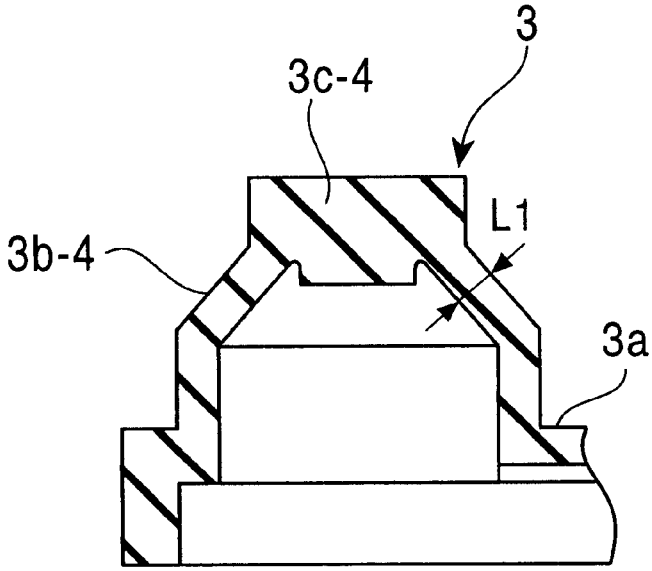
FIG. 8 is an enlarged sectional view of the main portion of a second spring section of the embodiment of the switch device in accordance with the present invention.
Figure 9:
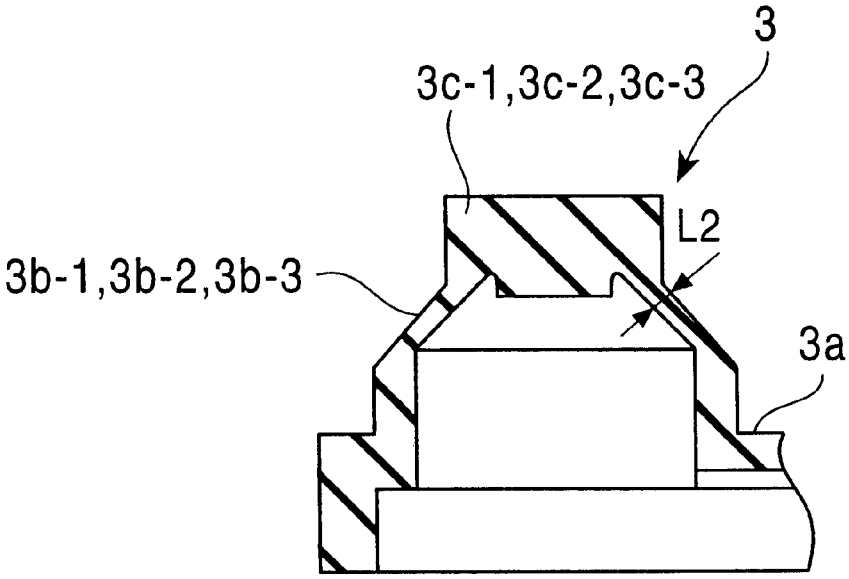
FIG. 9 is an enlarged sectional view of the main portion of a first spring section of the embodiment of the switch device in accordance with the present invention.
Figure 10:
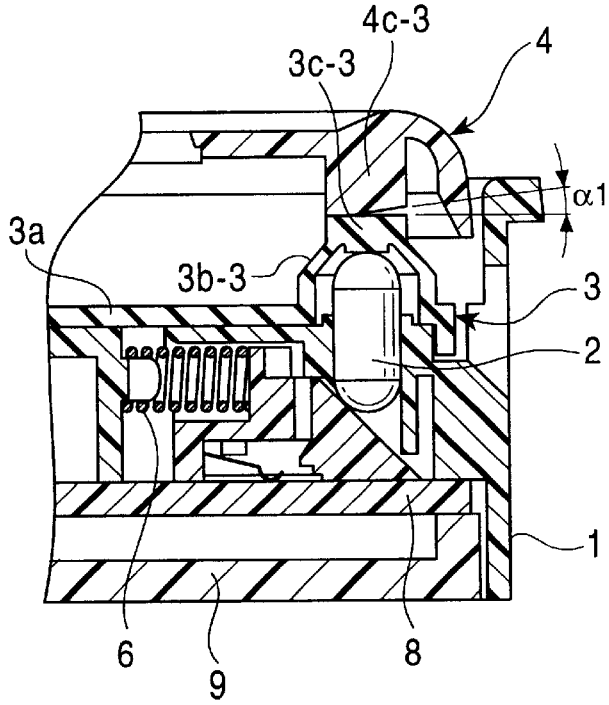
FIG. 10 is an enlarged sectional view of the main portion of embodiment of the switch device in accordance with the present invention.
Figure 11:
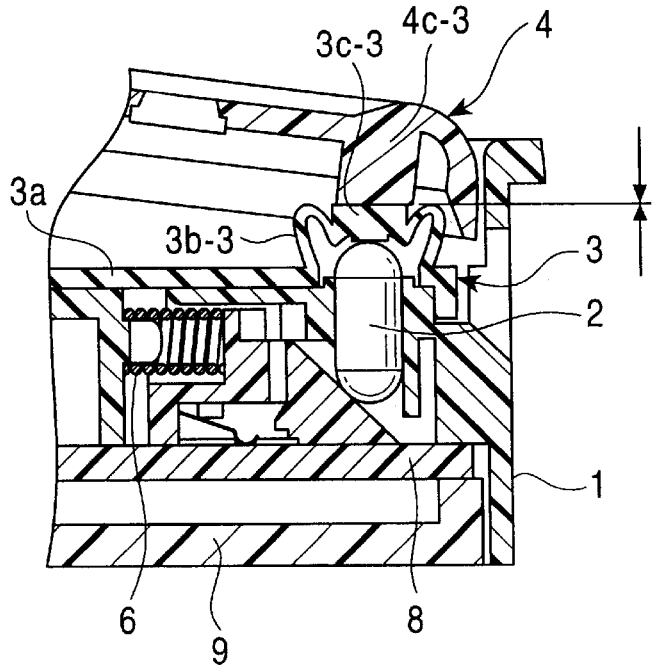
FIG. 11 is a first diagram illustrative of the operation of the switch device in accordance with the present invention.

As shown in FIG. 8, the wall thickness of the fourth spring section 3*b*-4 serving as a buckling section is L1 (for example, approximately 0.75 mm), whereas, as shown in FIG. 9, the wall thicknesses of the first, second, and third spring sections 3*b*-1, 3*b*-2, and 3*b*-3 are L2 (for example, approximately 0.65 mm) which are smaller than the wall thickness L1 of the fourth spring section 3*b*-4 (L1>L2).

The click ratio of the fourth spring section 3*b*-4 having a wall thickness of L1 is approximately 50%, whereas the click ratio of each of the three first, second, and third spring sections 3*b*-1, 3*b*-2, and 3*b*-3 having a wall thickness of L2 is independently approximately 33%. Here, the click ratio refers to the percentage ratio of the load after buckling to the load before buckling when a spring section is actuated.

The rubber spring 3 is accommodated inside the recess 1*c* in the case 1. Here, the actuating members 2 are disposed in contact with the inside surfaces of the corresponding first, second, and third presser sections 3*c*-1, 3*c*-2, and 3*c*-3. The hole 3*d* of the rubber spring 3 is disposed so as to oppose a square hole 1*e* of the case 1.

Figure 4:
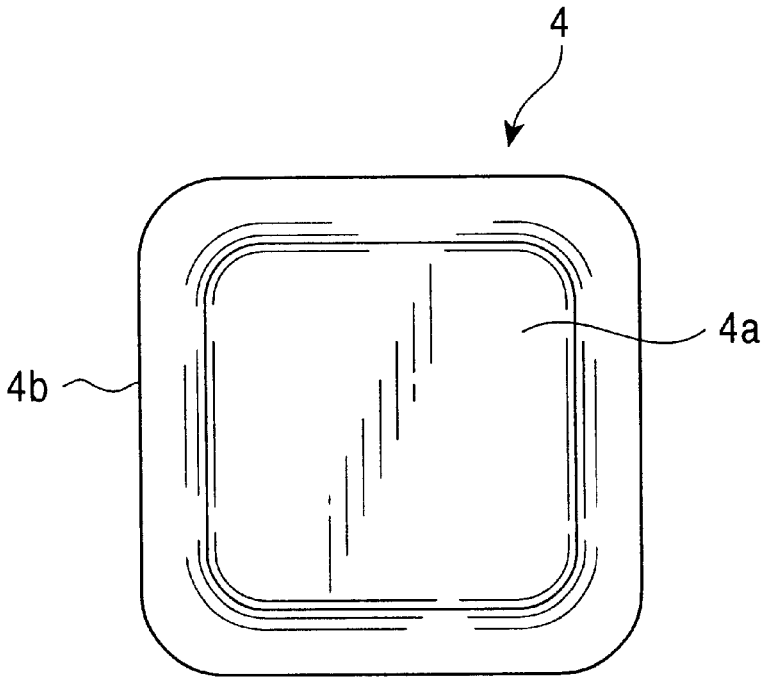
FIG. 4 is a plan view of an operating member of the embodiment of the switch device in accordance with the present invention.
Figure 5:
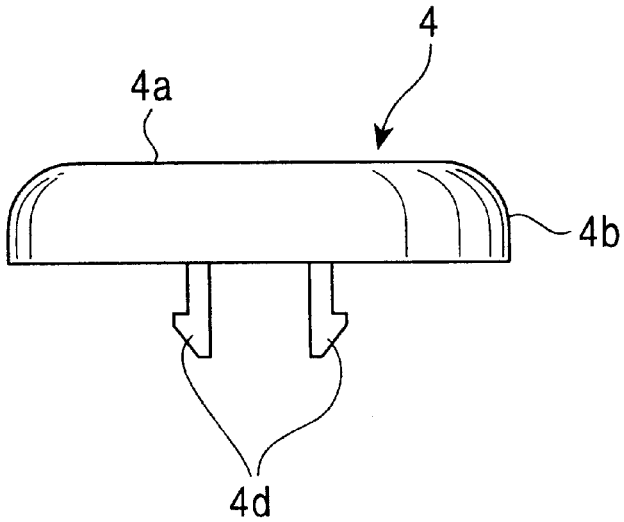
FIG. 5 is a side view of the operating member of the embodiment of the switch device in accordance with the present invention.
Figure 6:
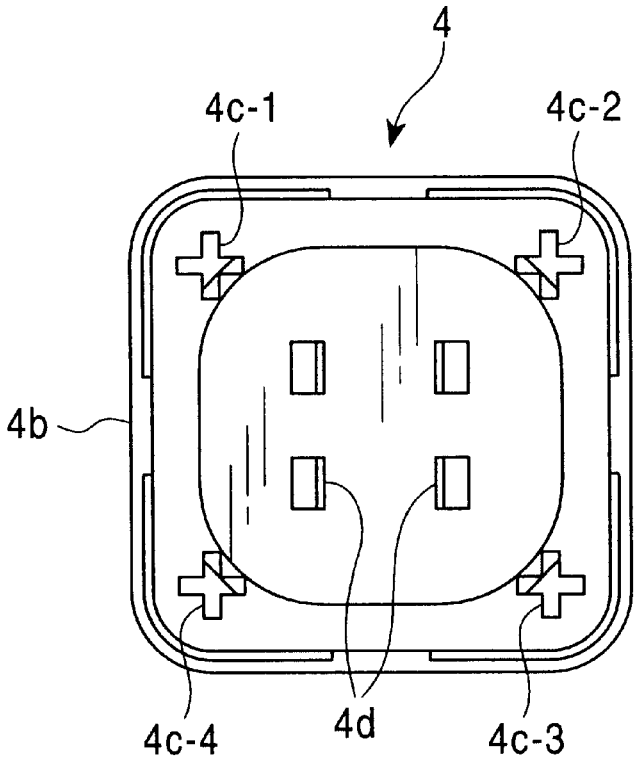
FIG. 6 is a bottom view of the operating member of the embodiment of the switch device in accordance with the present invention.

As shown in FIGS. 4 to 6, an operating member 4 is formed of, for example, a synthetic resin material by molding. The operating member 4 comprises a substantially rectangular top wall 4*a,* side walls 4*b,* cylindrical first, second, third, and fourth actuating sections 4*c*-1, 4*c*-2, 4*c*-3, and 4*c*-4 which are cross-shaped in cross section, and two pairs of engaging members 4d which protrude inwardly from substantially the center portion of the top wall 4*a*. The side walls 4*b* extend substantially vertically from the peripheral end of the top wall 4*a* so as to surround the peripheral portion of the top wall 4*a*. The first, second, third, and fourth actuating sections 4*c*-1, 4*c*-2, 4*c*-3, and 4*c*-4 protrude inwardly from near the four corresponding corners at the peripheral edges of the top wall 4*a*.

Figure 7:
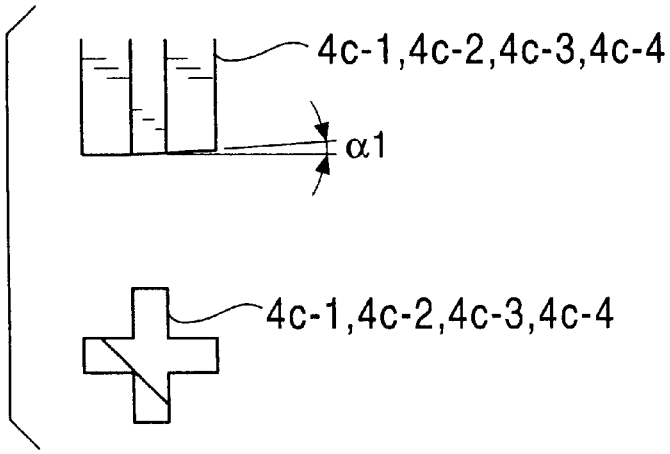
FIG. 7 is a first diagram illustrative of the operating member of the embodiment of the switch device in accordance with the present invention.

An end of each of the first, second, third, fourth actuating sections 4c-1, 4c-2, 4c-3, and 4c-4 of the operating member 4 is formed with a predetermined tilt angle with respect to the top tall 4a, that is, a horizontal plane so as to extend radially outward from substantially the center of the operating member 4. Here, as shown in FIG. 7, the end of each of the first, second, third actuating sections 4c-1, 4c-2, 4c-3, and 4c-4 is formed with an equal tilt angle $\alpha 1$ of, for example, approximately three degrees.

This one operating member 4 is disposed inside the recess 1c so as to virtually cover the open end of the recess 1c of the case 1. At this time, the ends of the first, second, third, and fourth actuating sections 4c-1, 4c-2, 4c-3, and 4c-4 are in contact with and oppose flat surfaces of ends of the first, second, third, and fourth presser sections 3c-1, 3c-2, 3c-3, and 3c-4 of the rubber spring 3, respectively. When the first, second, third, and fourth presser sections 3c-1, 3c-2, 3c-3, and 3c-4 are in contact with their corresponding first, second, third, and fourth actuating sections 4c-1, 4c-2, 4c-3, and 4c-4, the operating member 4 remains pushed outward (that is, resiliently biased outward) from the case 1.

Here, the two pairs of engaging members 4d of the operating member 4 are engaged with the peripheral wall of the square hole 1e formed at the recess 1c by a suitable means, such as a snapping-in method. By the engagement of the two pairs of engaging members 4d with the peripheral wall of the square hole 1e, the operating member 4 is constructed so that it is not dislodged from the case 1, and so that it is rockably disposed inside the recess 1c in any of the four directions (such as the X-Y direction).

A plurality of sliding members 5 are provided, each of which comprises a substantially wedge-shaped base 5a, a recess 5b which is formed in the top surface of the corresponding base 5a, and an inclined section 5c which is formed at one end of the corresponding base 5a.

A plurality of sliding members (such as three sliding members) 5 are slidably accommodated inside the case 1. The ends 2b of each actuating member 2 is in contact with its corresponding inclined section 5c.

Coil springs 6 are formed of a metallic material so as to have spiral forms and predetermined diameters. One end of each coil spring 6 is accommodated inside the recess 5b of its corresponding sliding member 5, whereas the other end of each coil spring 6 is in contact with the case 1. By the coil springs 6, the corresponding sliding members 5 are resiliently biased to one side.

Movable contacts 7 are formed of a metallic material, such as phosphor bronze, by a pressing operation, and comprise a plurality of sliding elements 7a. The movable contacts 7 are affixed to the corresponding sliding members 5 by a suitable means, such as thermal caulking, so that the movable contacts 7 slide as their corresponding sliding members 5 slide.

A printed wiring board 8 comprises a plurality of stationary contacts (such as three stationary contacts) 8a which are formed on one surface thereof, one light-emitting element 8b, and a plurality of solder lands 8c.

The printed wiring board 8 is disposed inside the case 1.

The sliding members 5 having the corresponding movable contacts 7 affixed thereto are disposed above the printed wiring board 8 at locations which allow the movable contacts 7 to come into contact with and separate from their corresponding stationary contacts 8a. The sliding members 5 are formed such that, when they slide, the corresponding movable contacts 7 slide above their corresponding stationary contacts 8a so as to come into contact with and separate from their corresponding stationary contacts 8a.

Here, the stationary contacts 8a and their corresponding sliding members 5 having the corresponding movable contacts 7 affixed thereto form what are called switches. The switches are constructed only at locations which oppose their corresponding first, second, and third presser sections 3c-1, 3c-2, and 3c-3 of the rubber spring 3. Each of the switches is actuated by its corresponding actuating member 2.

A cover 9 is formed of, for example, a synthetic resin material by molding. The cover 9 comprises a substantially rectangular wall 9a, side walls 9b which extend substantially vertically from the peripheral edge of the wall 9a, and a plurality of terminals 9c which are formed integrally with and on the wall 9a by insert molding. The printed wiring board 8 is disposed on the wall 9a of the cover 9 with the terminals 9c being passed through their corresponding solder lands 8c. Here, the solder lands 8c and the terminals 9c are soldered together, whereby the printed wiring board 8 and the cover 9 are integrally formed.

The cover 9 which is formed integrally with the printed wiring board 8 is disposed so as to cover the open portion (not shown) of the case 1. The case 1 and the cover 9 are engaged together by a suitable means, such as a snapping-in connecting operation.

A description of the operation of the switch device of the present invention will now be given.

First, as shown in FIG. 1, when the operator presses, for example, substantially the center portion of the lower left end side of the operating member 4 shown in FIG. 1 with, for example, his/her finger (not shown), the operating member 4 tilts to the left side. When the operating member 4 tilts to the left side, the first and second actuating sections 4c-1 and 4c-2. of the operating member 4 are pushed downward. When the first and second actuating sections 4c-1 and 4c-2 are pushed downward, the first and second presser sections 3c-1 and 3c-2 of the rubber spring 3 which have been brought into contact with their corresponding first and second actuating sections 4c-1 and 4c-2 are pushed downward.

When the first and second presser sections 3c-1 and 3c-2 of the rubber spring 3 are pushed, the first and second spring sections 3b-1 and 3b-2 serving as buckling sections having the same click ratio (such as approximately 33%) are buckled as the operator is provided with a tactile feel, so that the operator is provided with a suitable, proper tactile feel. Here, the first and second presser sections 3c-1 and 3c-2 cause the two actuating members 2 which are in contact with the inside walls of their corresponding first and second presser sections 3c-1 and 3c-2 to be pushed and to slide downward.

When the two actuating members 2 slide downward, the ends 2b of each of the two actuating members 2 move downward on the inclined sections 5c of the two corresponding sliding members 5. At this time, the two sliding members 5 slide, along with their corresponding movable contacts 7, above their corresponding stationary contacts 8a which are formed on the printed wiring board 8 so as to go against the resilient forces of the corresponding coil springs 6.

When these two sliding members 5 slide, the corresponding movable contacts 7 come into contact with their corresponding stationary contacts 8a, so that two switches are brought into an on state at the same time.

Next, when the operator moves his/her finger off the operating member 4, the resilient forces of the two coil springs 6 cause the two corresponding sliding members 5 to slide back to their original positions. Here, the two movable contacts 7 separate from their corresponding stationary contacts 8*a,* so that the two switches are brought into an off state.

By the sliding of the two sliding members 5, the corresponding actuating members 2 are pushed upward, and the operating member 4 is pushed upward and restored to its original position by the self-restoring force of the rubber spring 3.

As shown in FIG. 1, when the operator presses, for example, substantially the center portion of the upper left end side of the operating member 4 shown in FIG. 1 with, for example, his/her finger (not shown), the operating member 4 tilts to the upper side. When the operating member 4 tilts to the upper side, the first and fourth actuating sections 4*c*-1 and 4*c*-4 of the operating member 4 are pushed downward. When the first and fourth actuating sections 4*c*-1 and 4*c*-4 are pushed downward, the first and fourth presser sections 3*c*-1 and 3*c*-4 of the rubber spring 3 which have been brought into contact with the corresponding first and fourth actuating sections 4*c*-1 and 4*c*-4 are pushed downward.

When the first and fourth presser sections 3*c*-1 and 3*c*-4 of the rubber spring 3 are pushed, the first and fourth spring sections 3*b*-1 and 3*b*-4 having different click ratios (such as approximately 33% and approximately 50%) are buckled as the operator is provided with a tactile feel, so that the operator is provided with a proper tactile feel.

Here, the first presser section 3*c*-1 causes the one actuating member 2 which is in contact with the inside wall of the first presser section 3*c*-1 to be pushed and to slide downward. When the one actuating member 2 slides downward, the ends 2*b* of the one actuating member 2 move downward on the inclined section 5*c* of the one sliding member 5 corresponding thereto. At this time, the one sliding member 5 slides, along with the corresponding movable contact 7, above the corresponding stationary contact 8*a* which is formed on the printed wiring board 8 so as to go against the resilient force of the corresponding coil spring 6.

When the one sliding member 5 slides, the corresponding movable contact 7 comes into contact with the corresponding stationary contact 8*a,* so that the corresponding one switch is brought into an on state.

As described above, a slight difference occurs between the tactile feel which is provided by the first spring section 3*b*-1 which is provided with its corresponding switch and the tactile feel which is provided by the fourth spring section 3*b*-4 which is not provided with a switch. However, the operator experiences a proper tactile feel of those of the two switches.

Next, when the operator moves his/her finger off the operating member 4, the resilient force of the corresponding one coil spring 6 causes the one corresponding sliding member 5 to slide back to its original position. Here, the corresponding movable contact 7 separates from its corresponding stationary contact 8*a,* so that the one switch is brought into an off state.

By the sliding of the one sliding member 5, the corresponding actuating member 2 is pushed upward, and the operating member 4 is pushed upward and restored to its original position by the self-restoring force of the rubber spring 3.

Thereafter, when the operator presses, for example, substantially the center portion of the lower right end side of the operating member 4 shown in FIG. 1 with, for example, his/her finger (not shown), operations similar to the operations which are performed when the lower left end side of the operating member 4 is pressed are performed, so that two switches are brought into an on state at the same time. The operations are virtually the same as the above-described operation, so that the details thereof will not be given below.

Next, when the operator presses, for example, substantially the center portion of the upper right end side of the operating member 4 shown in FIG. 1 with, for example, his/her finger (not shown), operations which are similar to those which are executed when the upper left end side of the operating member 4 is pressed are executed, causing one switch to be brought into an on state. The operations are virtually the same as the above-described operations, so that the details thereof will not be given below.

Accordingly, based on the direction of operation when any of the four pressing locations of the rectangular operating member 4 are rocked/operated, a determination is unambiguously made as to the location of the switch or the locations of the switches to be turned on or the number of switches to be turned on. Consequently, a determination is made as to which location (that is, the upper, lower, left, or right side) of the pressing portion of the operating member 4 is operated.

A description of the clicking characteristics in the operation of the switch device will now be given.

Figure 12:
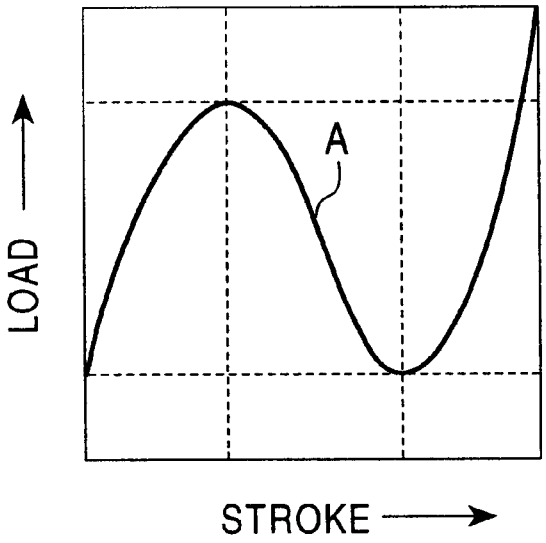
FIG. 12 is a graph illustrating the clicking characteristic which is provided when two switches of the switch device of the present invention are actuated.
Figure 13:
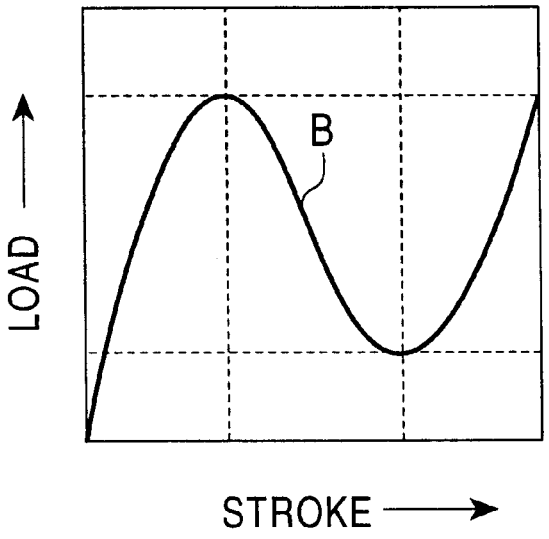
FIG. 13 is a graph illustrating the clicking characteristic which is provided when one switch of the switch device of the present invention is actuated.
Figure 14:
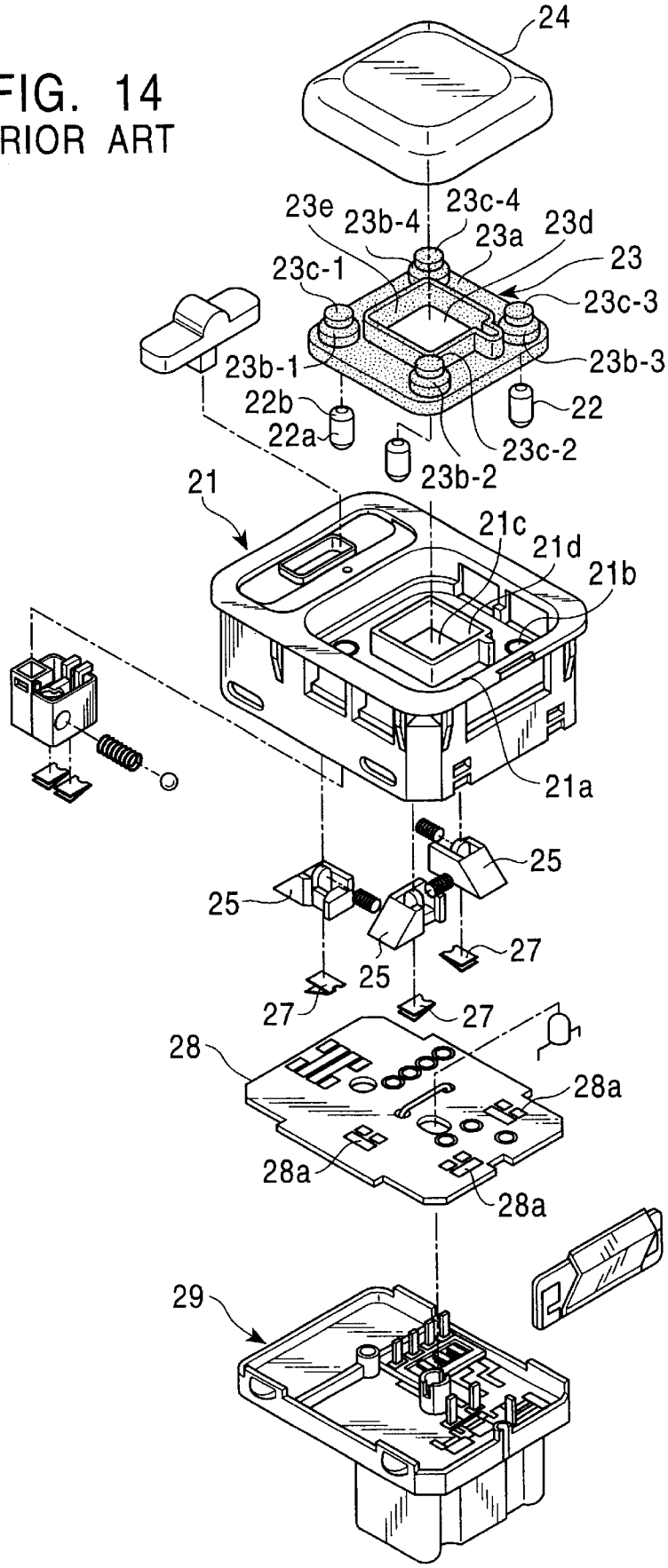
FIG. 14 PRIOR ART
FIG. 14 is an exploded perspective view of a conventional switch device.
Figure 15:
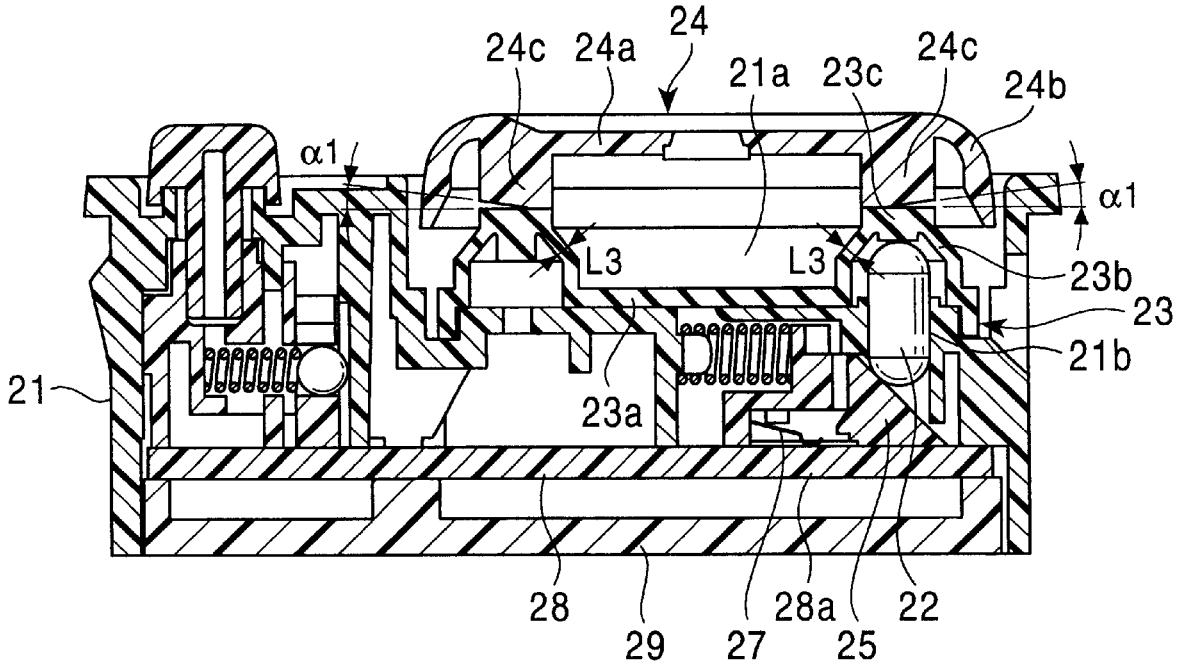
FIG. 15 PRIOR ART
FIG. 15 is an enlarged sectional view of the conventional switch device.
Figure 16:
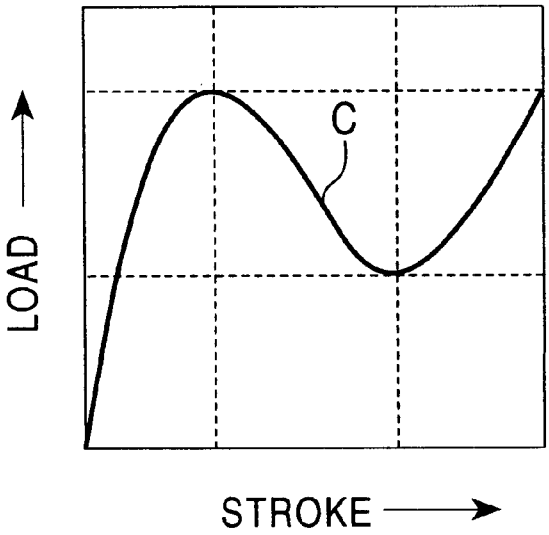
FIG. 16 PRIOR ART
FIG. 16 is a graph illustrating the clicking characteristic which is provided when two switches of the conventional switch device are actuated.
Figure 17:
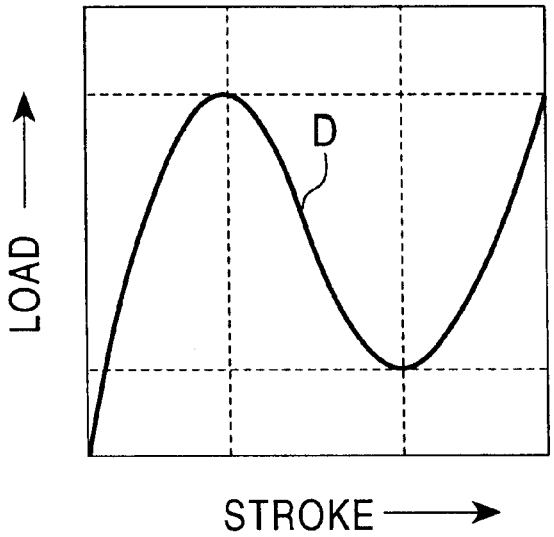
FIG. 17 PRIOR ART
FIG. 17 is a graph illustrating the clicking characteristic which is provided when one switch of the conventional switch device is actuated.

FIG. 12 is a graph illustrating the clicking characteristic which is provided when two switches are actuated as a result of pressing substantially the center portion of the lower left end side of the operating member in the switch device of the present invention shown in FIG. 1. FIG. 13 is a graph illustrating the clicking characteristic which is provided when one switch is actuated as a result of pressing substantially the center portion of the upper left end side of the operating member in the switch device of the present invention shown in FIG. 1.

The clicking characteristic which is represented by graph A shown in FIG. 12 is obtained when two switches are actuated. The clicking characteristic is such that the difference between the peak value and the bottom value is somewhat small because the tactile feel which is produced by the buckling of two spring sections of the rubber spring 3 is diminished as a result of the operation of two switches which are actuated by the operation of the operating member 4.

The clicking characteristic which is represented by graph B shown in FIG. 13 is obtained when one switch is actuated. To obtain this clicking characteristic, only one switch is actuated by the operation of the operating member 4, so that the tactile feel which is produced by the buckling of two spring sections of the rubber spring 3 is diminished by an amount corresponding to the operation of only one switch. However, since the fourth spring section 3*b*-4 of the rubber spring 3 has a rather large click ratio, the rubber spring 3 cannot buckle smoothly, thereby producing this clicking characteristic. The clicking characteristic which is represented by Graph B in which the difference between the peak value and the bottom value is somewhat small is obtained. The clicking characteristic which is represented by graph B is substantially the same as that which is represented by graph A.

In the above-described switch device, the click ratios of the corresponding spring sections are made different as a result of forming the spring sections (that is, the buckling sections) of the rubber spring with different wall thicknesses (that is, the thicknesses). However, the present invention is not limited thereto. Therefore, for example, the click ratio of each of the spring sections may be made different by forming each of the spring section with a different length or a different tilt angle with respect to the base.

As can be understood from the foregoing description, according to the switch device of the present invention, the spring sections are buckled as a result of actuating them in order to switch the corresponding switches. With regard to the click ratios of two spring sections which are provided with two corresponding switches which are actuated at the same time by the operating member, the click ratio of one of the spring sections is larger than the click ratio of the other spring section. Therefore, even if two spring sections which are provided with two corresponding switches are actuated by the operating member, the operator is provided with a proper tactile feel. Since the tactile feel which is provided is virtually the same as that provided when two spring sections which are provided with one switch are actuated, it is possible to provide a switch device which allows the operator to experience a substantially uniform tactile feel regardless of which of the four directions the operating member is actuated.

When four spring sections are disposed at locations which oppose four corners of the operating member, respectively, it is possible to provide a switch device in which the actuation of the operating member can be reliably achieved.

When each spring section comprises a buckling section, and when the wall thickness of the buckling section of the spring section having the click ratio which is greater than the click ratios of the three other spring sections is greater than the wall thicknesses of the three other buckling sections, it is possible to provide a low-cost switch device in which a plurality of buckling sections having different click ratios can be easily formed.

When each spring section comprises a buckling section, and when the tilt angle with respect to the case of the buckling section of the spring section having the click ratio which is greater than the click ratios of the three other spring sections is greater than the tilt angles of the three other buckling sections with respect to the case, it is possible to provide a low-cost switch device in which a plurality of buckling sections having different click ratios can be easily formed.

When the click ratio of the spring section which is greater than the click ratios of the three other spring sections is approximately 50%, and when the click ratios of the three other spring sections are approximately 33%, it is possible to provide a switch device which provides almost uniform tactile feel in all of the directions in which the operating member is actuated.

When the operating member is resiliently biased by the spring sections, and when the operating member is stopped at the case by a resilient force, it is possible to provide a low-cost switch device which can be easily assembled because the operating member can be easily stopped at the case.

When each switch comprises a printed wiring board which is disposed inside the case, a stationary contact which is formed on the corresponding printed wiring board, a slider which slides above the corresponding printed wiring board, and a movable contact which is disposed at its corresponding slider, and when each slider slides by its corresponding spring section in order to switch its corresponding switch, it is possible to provide a low-cost switch device whose switches can be formed at a lower cost compared to a single switch which is accommodated in a housing.

What is claimed is:

1. A switch device comprising:

an operating member which is stopped by a case so as to be rockable in four directions;

a rubber spring including four dome-shaped spring sections, one first dome-shaped spring section and three second dome-shaped spring sections, the dome-shaped spring sections being disposed at peripheral edges of the operating member inside the case, respectively, the dome-shaped spring sections being selectively actuated two at a time as a result of rocking the operating member in one direction; and three switches which are disposed in correspondence with the three second dome-shaped spring sections, with the remaining one first dome-shaped spring section not being provided with a switch;

wherein the dome-shaped spring sections are actuated and buckled by operating the operating member to switch the switches; and wherein a click ratio of the first spring section is greater than click ratios of the second dome-shaped spring sections.

2. A switch device according to claim 1, wherein the four dome-shaped spring sections are disposed at locations which oppose four corners of the operating member, respectively.

3. A switch device according to claim 2, wherein each spring section comprises a buckling section, and wherein a wall thickness of the buckling section of the first spring section is greater than wall thicknesses of the buckling sections of the second spring sections.

4. A switch device according to claim 2, wherein each spring section comprises a buckling section, and wherein a tilt angle of the buckling section of the first spring section with respect to the case is greater than tilt angles of the buckling sections of the second spring sections with respect to the case.

5. A switch device according to claim 2, wherein the operating member is resiliently biased by the spring sections, the operating member being stopped at the case by a resilient force thereof.

6. A switch device according to claim 2, wherein each switch comprises a stationary contact which is formed on a printed wiring board in the case, a slider which slides above its corresponding printed wiring board, and a movable contact which is disposed at its corresponding slider, and wherein each slider slides by its corresponding spring section to switch its corresponding switch.

7. A switch device according to claim 1, wherein the click ratios of the second spring sections are the same.

8. A switch device according to claim 1, wherein the click ratio of the first spring section is one-and-a-half times a click ratio of a second spring section.

* * * * *

UNITED STATES PATENT AND TRADEMARK OFFICE

CERTIFICATE OF CORRECTION

PATENT NO. : 6,515,242 B2
DATED : February 4, 2003
INVENTOR(S) : Hiroki Takatsuki It is certified that error appears in the above-identified patent and that said Letters Patent is hereby corrected as shown below:

Column 12,
Line 26, insert -- dome-shaped -- after “first”.

Signed and Sealed this

Fifth Day of August, 2003

JAMES E. ROGAN
*Director of the United States Patent and Trademark Office*